US007121676B1

(12) United States Patent
Kutnyak

(10) Patent No.: US 7,121,676 B1
(45) Date of Patent: Oct. 17, 2006

(54) ILLUMINATED PROTECTIVE HEADGEAR

(76) Inventor: Mark Kutnyak, S91 W22600 Fatima Dr., Big Bend, WI (US) 53103

( * ) Notice: Subject to any disclaimer, the term of this patent is extended or adjusted under 35 U.S.C. 154(b) by 136 days.

(21) Appl. No.: 10/775,447

(22) Filed: Feb. 10, 2004

Related U.S. Application Data

(63) Continuation-in-part of application No. 10/355,423, filed on Jan. 30, 2003, now abandoned.

(51) Int. Cl.
*F21V 21/084* (2006.01)

(52) U.S. Cl. ..... 362/105; 362/234; 362/806

(58) Field of Classification Search ..... 362/105, 362/106, 231, 234, 806; 2/906; 361/752
See application file for complete search history.

(56) References Cited

U.S. PATENT DOCUMENTS

| | | | | |
|---|---|---|---|---|
| 4,186,429 | A | 1/1980 | Johnston | |
| 4,231,079 | A | 10/1980 | Heminover | |
| 4,319,308 | A | 3/1982 | Ippoliti et al. | |
| 4,559,586 | A * | 12/1985 | Slarve | 362/106 |
| 4,760,373 | A | 7/1988 | Reilly | |
| 4,891,736 | A * | 1/1990 | Gouda | 362/105 |
| 4,956,752 | A | 9/1990 | Foglietti | |
| 4,999,747 | A | 3/1991 | Chen | |
| 5,111,366 | A | 5/1992 | Rife et al. | |
| 5,147,129 | A * | 9/1992 | Ku | 362/106 |
| 5,183,324 | A | 2/1993 | Thomas | |
| 5,327,587 | A | 7/1994 | Hurwitz | |
| 5,327,588 | A | 7/1994 | Garneau | |
| 5,329,637 | A | 7/1994 | Walker | |
| 5,353,008 | A | 10/1994 | Eikenberry et al. | |
| 5,357,409 | A | 10/1994 | Glatt | |
| 5,408,393 | A | 4/1995 | Becker | |
| 5,416,675 | A | 5/1995 | DeBeaux | |
| 5,426,792 | A | 6/1995 | Murasko | |
| 5,469,342 | A | 11/1995 | Chien | |
| 5,479,325 | A | 12/1995 | Chien | |
| 5,508,900 | A | 4/1996 | Norman | |
| 5,544,027 | A | 8/1996 | Orsano | |
| 5,559,680 | A | 9/1996 | Tabanera | |
| 5,564,128 | A | 10/1996 | Richardson | |
| 5,570,946 | A | 11/1996 | Chien | |
| 5,588,736 | A | 12/1996 | Shea, Sr. | |
| 5,615,940 | A * | 4/1997 | Barry | 362/473 |
| 5,743,621 | A | 4/1998 | Mantha et al. | |
| 5,758,947 | A | 6/1998 | Glatt | |
| 5,871,271 | A | 2/1999 | Chien | |
| 6,007,213 | A | 12/1999 | Baumgartner | |
| 6,113,244 | A | 9/2000 | Baumgartner | |
| 6,244,721 | B1 | 6/2001 | Rodriguez et al. | |
| 6,325,521 | B1 | 12/2001 | Gregg et al. | |

(Continued)

*Primary Examiner*—Renee Luebke
*Assistant Examiner*—Gunyoung T. Lee
(74) *Attorney, Agent, or Firm*—Quarles & Brady LLP

(57) ABSTRACT

An illuminated protective headgear (10) has an inner core (11) of resilient cushioning material with cavities (18*a*, 18*b*, 19*a*, 19*b*), an outer shell (12) with portions overlying said core (11) with windows (13) that are clear to translucent or open and are of graphical configuration disposed on opposite sides of the headgear (10), and a power circuit supported by said inner core with lighting panels (44) having light sources (21–23, 25–27, 21*a*–23*a*, 25*a*–27*a*) disposed in the cavities (18*a*, 18*b*) so as to be viewed through a respective window (13), and timing circuitry for timing the on-off sequence of the lights, so as to create an effect of motion of the illumination within each window (13). Several embodiments are disclosed.

38 Claims, 7 Drawing Sheets

U.S. PATENT DOCUMENTS 6,328,454 B1 12/2001 Davis
6,752,510 B1 * 6/2004 Appiah ..... 362/106
2002/0159250 A1 * 10/2002 Kuo et al. ..... 362/106

* cited by examiner

FIG. 1
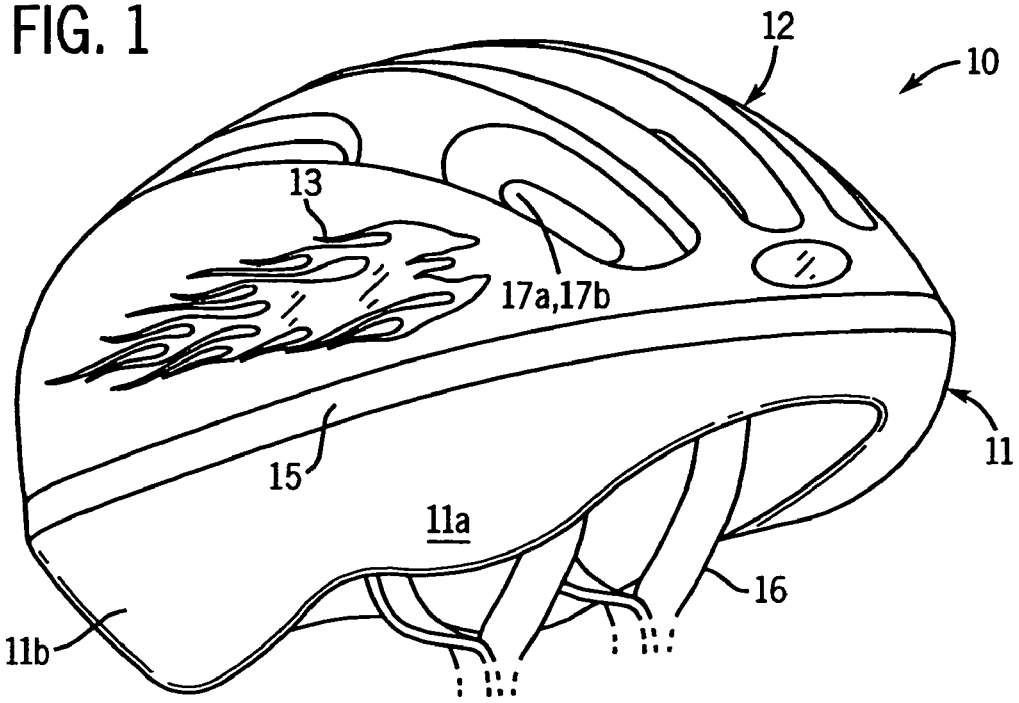
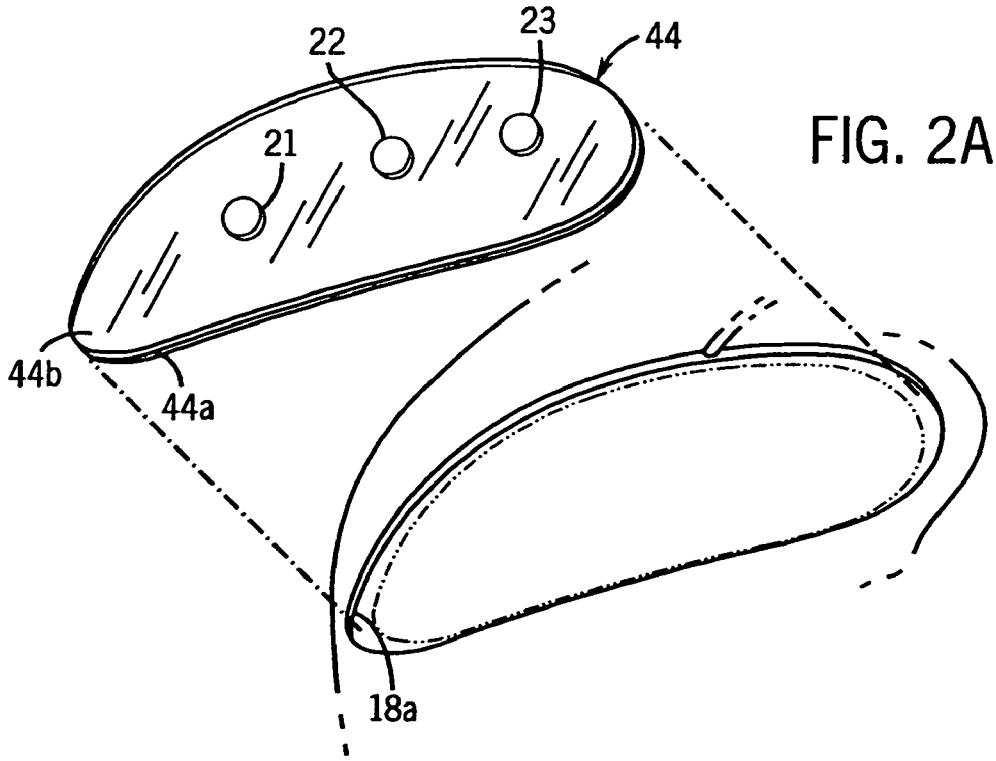
FIG. 2A

ILLUMINATED PROTECTIVE HEADGEAR

CROSS REFERENCE TO RELATED APPLICATION

This is a continuation-in-part of my prior U.S. patent application Ser. No. 10/355,423, filed Jan. 30, 2003, now abandoned.

TECHNICAL FIELD

The present invention relates to an illuminated headgear of the type worn by adults and children for work-related and recreational activities.

BACKGROUND ART

The use of various protective headgears is growing in today's society. Protective headgears are used in many recreational activities including, but not limited to, cycling, walking, running and participation in sports activities. These activities may be carried out at night or in low light conditions such that illumination would be advantageous. For example, strips of reflective material are well known for use in jogging clothing and shoes.

There have been attempts to develop illuminated headgears in industrial fields such as for mining and construction, for firefighting, and more recently for recreational use, including motorcycling.

Such headgears have been limited to use of large incandescent lights, electroluminescent light strips and more recently to use of small lighting elements such as light emitting diodes (LEDs).

Ippoliti et al., U.S. Pat. No. 4,319,308, discloses a motorcycle helmet which makes use of LEDs to direct light between two thin shells of curvilinear profile such that characters, such as alphabet letters, are illuminated on the side of the helmet. The light sources are located in the bottom of the helmet to direct light upward and generally parallel to the thin shells, with light being reflected between the shells due to the curvilinear profile of the shells.

Chien, U.S. Pat. No. 5,871,271, shows a cycling helmet with hard shell outer layer and a protective shock absorbing layer in which LEDs in star shapes and other shapes are proposed to be mounted on circuit boards that fit within recesses in the helmet. In one embodiment, the LED's are placed inside of enclosures with opaque and translucent portions to form illuminated star shapes. These shapes are quite small and intended to impart a shape to an individual LED element.

Mantha et al., U.S. Pat. No. 5,743,621, shows a helmet with illuminated translucent panels in the front and back of the helmet.

Many other prior patents show various types of illuminated headgears. Although each type of illumination process has their advantages and disadvantages, they are for the most part non-cost effective, difficult to produce and not very eye-appealing to the consumer. As a result these designs have not been widely seen in the recreational field.

Another technical problem in providing illuminated headgears, is retaining the strength of the helmet to impacts. Thus, the lighting assemblies should not result in a weakening of the structure of the headgear or a substantial lessening of the headgear's ability to distribute and absorb energy due to an impact.

SUMMARY OF THE INVENTION

It is a general object of the present invention to produce illuminated protective headgears for a variety of uses that are relatively inexpensive, simple to manufacture and have a low number of components, while having superior visual effects and commercial appeal for the user and the consumer, while retaining the strength of the headgear in resisting impacts.

A more specific object of the present invention is to improve on the lighting effects of illuminated headgears, by providing a headgear in which various graphical designs may be used in multi-element flashing light displays to show the location of the user by providing a motion effect. In this context, the term "graphical" is intended to exclude mere configurations of alphabetic letters and numerals of a type shown in the prior art and generic geometric shapes such as squares, triangles, and circles.

The invention can be further enhanced by utilizing multi-colored elements or by operating the light sources to achieve a strobing effect.

While the invention is disclosed in the context of a headgear for recreational uses, the headgear of the present invention may be adopted for other uses not described herein.

Also disclosed are advantageous features in construction to achieve the above objects. These and other objects and advantages of the invention will be apparent from the description that follows and from the drawings, which are incorporated herein, and which illustrate preferred embodiments of the invention. The invention is not limited to such preferred embodiments, but is instead defined by the claims which follow the description.

BRIEF DESCRIPTION OF THE DRAWINGS

FIG. 1 is a perspective view of a headgear of the present invention;

FIG. 2A is a detail view a portion of FIG. 2;

DETAILED DESCRIPTION OF THE PREFERRED EMBODIMENTS

Figure 2:
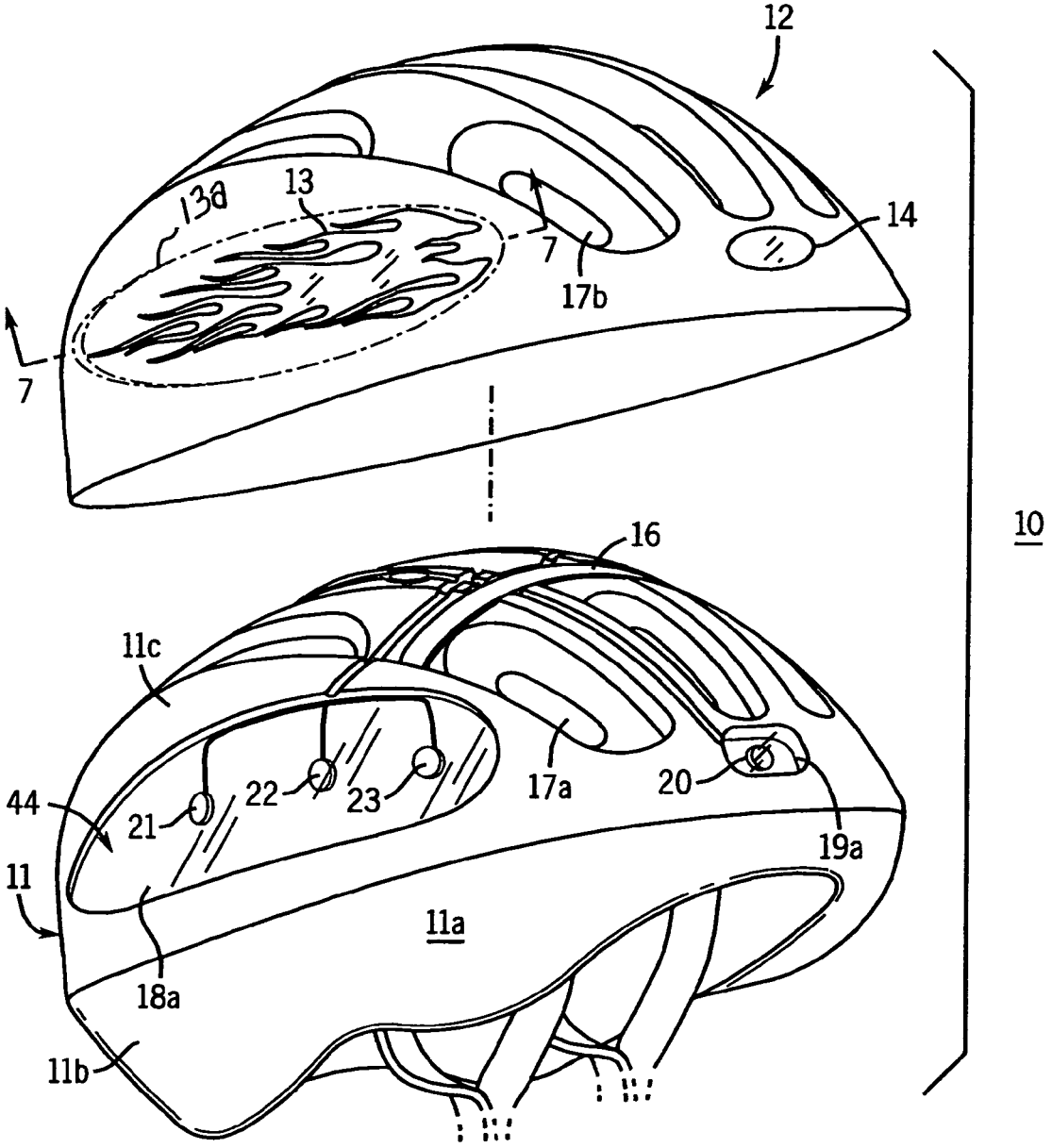
FIG. 2 is an exploded perspective view of the headgear of FIG. 1.

FIGS. 1–6 illustrate preferred embodiments of an illuminated protective headgear 10 of the present invention which is capable of producing the desired visual effects. The headgear 10 utilizes an inner, protective, impact-absorbing core 11 provided by molding structural polymeric foam or similar material. This core 11 has a general convex exterior surface and a general concave interior that conforms to the shape of the head of the individual. It extends in a downwardly turned fashion to provide a first ridge area 11*a* partly covering the sides and a second ridge area 11*b* extending further down the back portion of the helmet. The impact-absorbing core 11 includes any necessary padding material. Straps 16 (FIGS. 2 and 3) are threaded through slots 11*d* (FIG. 3) in the core 11 and fastened together at the chin of a user. Other devices currently known in the art can also be used to secure the headgear on the head of the user.

Generally, the hard outer plastic shells currently found in bicycle helmets use a color additive added to the molded or extruded plastic material to produce a solid through color. They may also be painted or anodized to impart additional color. In contrast thereto, in the preferred embodiment of the present invention, the outer shell 12 is made of a clear transparent or milky white translucent polycarbonate, PETG (polyethylene terephthalate) or any other hard clear or translucent plastic material corresponding to the shape of the upper portion of the inner protective impact-absorbing core 11.

In the illustrated embodiments, there are two large windows 13 or 13*a* (one being shown in FIGS. 1 and 2, the other being a mirror image) on opposite long sides of the elliptically shaped headgear 10. In one embodiment the windows 13 have a graphical configuration and are solid. In another embodiment, the windows 13*a* have an elliptical configuration, which is considered a generic shape and, therefore, non-graphical. It would also be possible for the windows to be open as will be explained further below. There are two small windows 14 at the front and back of the headgear. The large windows 13 are configured as flames, a graphical shape, while the smaller windows at the front and back 14 have an elliptical shape.

The inside, outside or both areas of the translucent shell 12 can be either painted or anodized to provide an opaque area on the shell 12. By using a stencil or other various techniques, windows 13, 14 in a desired graphical shape can be preserved within the opaque area. The opaque film material is then applied to cover the remaining portions of the clear or translucent shell 12 around the windows 13, 14. As seen in FIG. 2, to assemble the headgear 10, the outer plastic shell 12 is placed on top of the impact-absorbing core 11, fitting the two sections together. The shell 12 is then releasably attached to the upper portion of the inner impact-absorbing core with a suitable material, such as plastic vinyl tape 15, which is commonly used in today's recreational bicycle helmets. The two portions are secured together around the headgear's latitudinal circumference using tape 15. The tape 15 defines a dividing line, which separates an upper portion 11*c* of the impact-absorbing core from the lower portions 11*a*, 11*b* below this boundary. Additionally, the illuminated headgear contains multiple molded corresponding slots 17*a*, 17*b* in and through both the impact-absorbing core 11 and the outer shell 12 to aid in the ventilation process.

Figure 3:
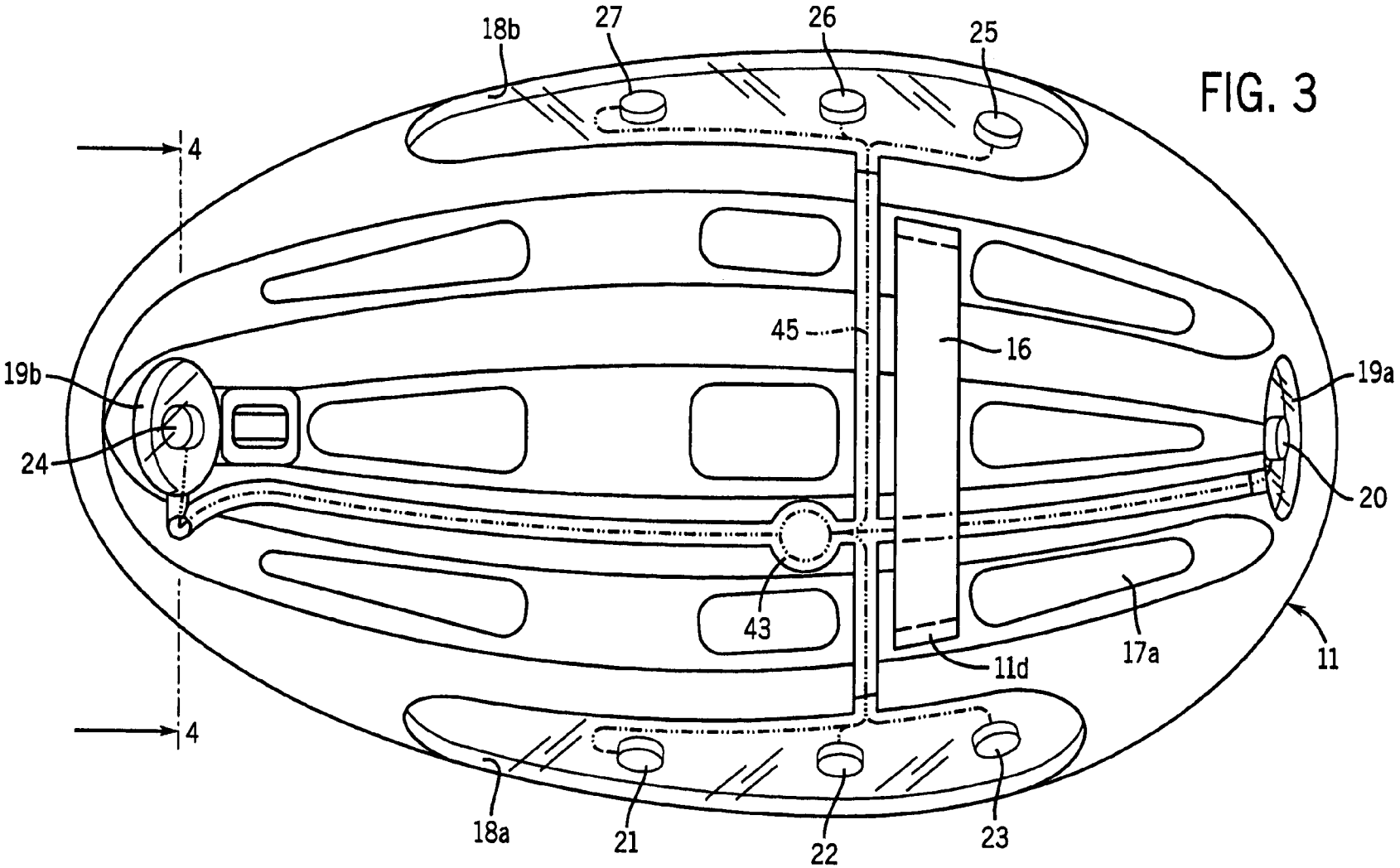
FIG. 3 is a top plan view of the headgear of FIGS. 1 and 2 with the outer shell removed.

As seen in FIGS. 2 and 3, there are a number of shallow cavities 18*a*, 18*b*, 19*a*, 19*b* in the periphery of the upper portion 11*c* in the impact-absorbing core 11. The shallow cavities 18*a*, 18*b*, 19*a*, 19*b* are located in the right and left sides and the front and rear of the impact-absorbing core 11 and correspond generally to the size and shape and location of the transparent or translucent windows 13, 14 of the hard outer shell 12 when these two pieces are assembled.

Located within these shallow cavities 18*a*, 18*b*, 19*a*, 19*b* are one or more light sources 20–27. The light sources 20–27 may be secured directly in the foam core 11, or as seen in FIG. 2A, the light sources 20–27, as exemplified by elements 21–23, may be mounted on substrates 44*a* that are curved along a profile corresponding to the shape of the outer surface of the core. These substrates 44*a* with their accompanying light sources 21–23 and 25–27 conform to the general planar shape of the shallow cavities 18*a*, 18*b* containing them. Additionally, they act as impact distribution members. The wide base of each light source 21–23 is more evenly distributed over a larger area of the substrate 44*a*. As compared to standard small base LEDs, the light sources 21–23 are retained on the substrate 44*a* and the impact-absorbing core 11 in the event of a hard impact to the window area of the hard outer shell 12. The light sources 21–23 are mounted and electrically connected in parallel on the substrate 44*a*, which is secured to the bottom of cavity 18*a*. The arrangement would be the same on the opposite side of the impact-absorbing core 12. Front cavity 19*a* contains an individual light source 20 (FIGS. 2 and 3), which may also be mounted on a circuit board (not shown) and similarly secured in cavity 19*a*. The arrangement would be the same for the light source 24 (FIG. 3) in the back cavity 19*b* in the impact-absorbing core.

Figure 4:
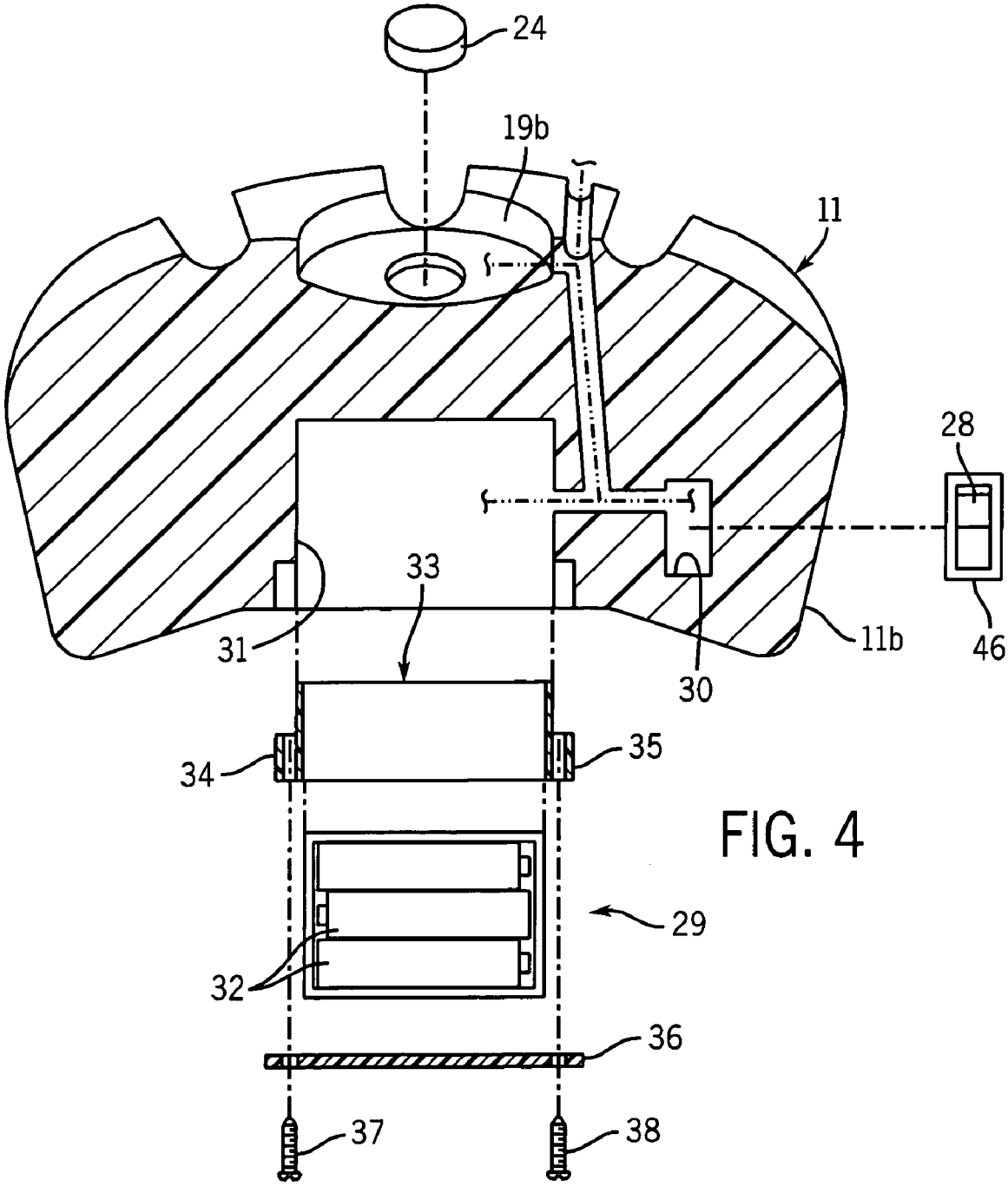
FIG. 4 is a sectional view taken in a plane indicated by line 4—4 in FIG. 3.

Each substrate 44*a* contains the traces or wires which connect through wires 45 in parallel connection to an on-off switch 28 and electrical energy source 29, which are located in cavities 30, 31 (FIG. 4). The wires 45 are located in the upper portion of the outer periphery of the impact-absorbing core 11 and are secured in place with plastic vinyl tape or other suitable material.

It is also possible to provide small individual battery sources for each light source. These can be turned on and off by pressing or screwing the battery sources to an active position from an inactive position. In that case, the wiring and the battery described below are not necessary.

The light sources 20–27 are soldered to their respective substrates 44*a* and secured in their selected shallow cavities 18*a*, 18*b*, 19*a* and 19*b*. They are covered by the hard outer plastic shell 12 having their respective windows 13, 14 reasonably corresponding to the general shape of the shallow cavity contained underneath. The light sources 20–27 can be composite light emitting diode components that are super bright, wide-based, low-profiled, having a wide angle of view, and having at least two like-colored or different-colored light elements each. The light sources 20–27 each contain their own timing circuitry which, together with light emitting diode elements, is contained in a clear encapsulation material. In addition, the light sources 20–27 and their substrate 44*a* are encapsulated in a layer of transparent, solid material 44*b* such as an epoxy-based material which is applied over the substrates 44*a* and the lighting sources 20–27 and allowed to cure to form a solid lighting panel assembly 44. This construction imparts a stiffness to the lighting panels 44, so that when they are placed in the cavities 18*a*, 19*a* in the core 11, they will provide a sealed semi-rigid assembly that will withstand impacts to the headgear without collapsing under forces applied under testing standards. In other embodiments, the windows 13 could be open apertures for receiving the lighting panels 44, which would provide a surface flush with an outer surface of the shell 12.

Figure 6:
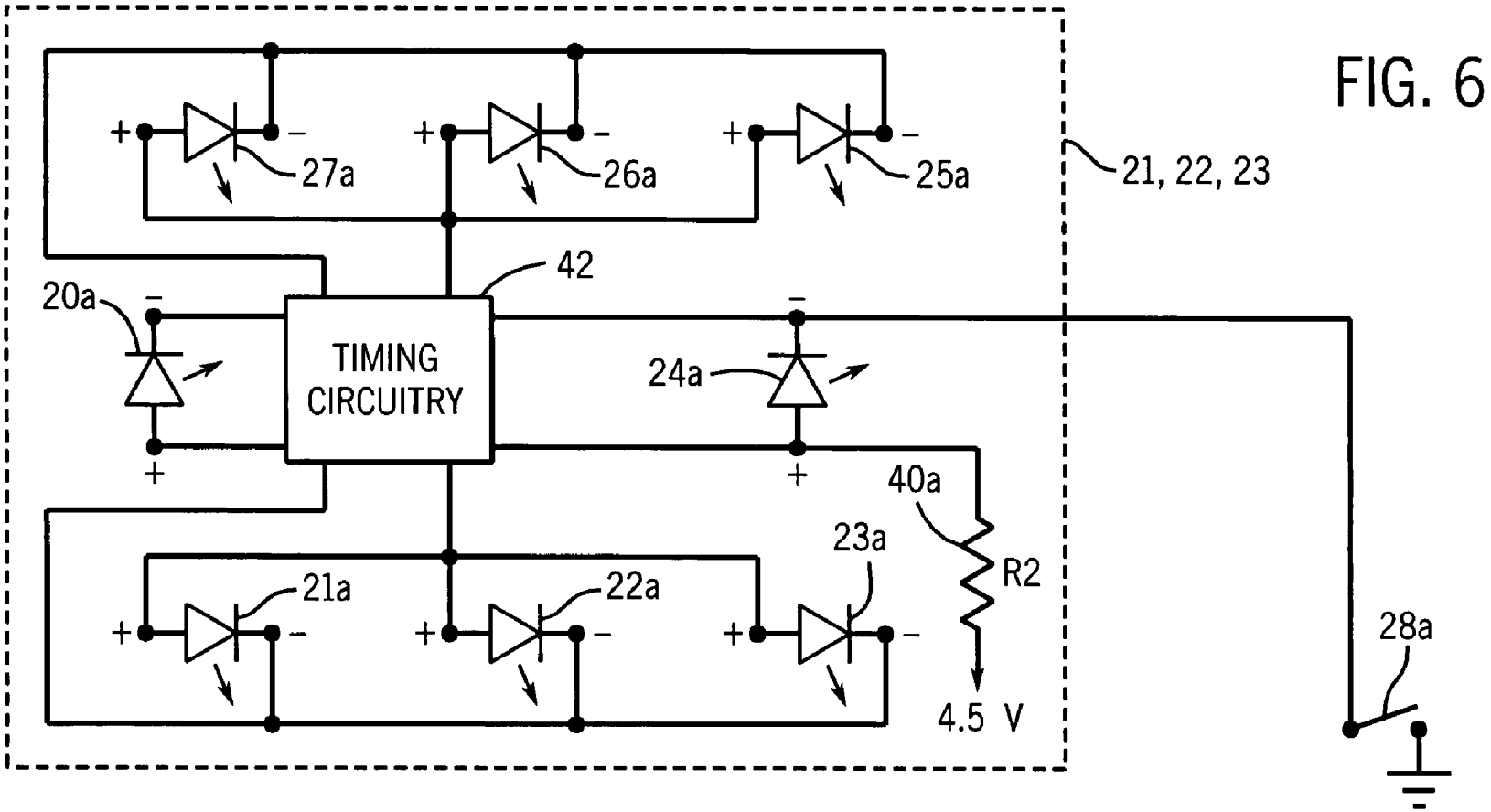
FIG. 6 is a schematic diagram of an electrical circuit board in another embodiment of a headgear of the present invention.

In another preferred embodiment, represented by FIG. 6, each light source 21, 22 and 23 represented in FIG. 2 includes a plurality of individual light elements 20*a*–27*a* controlled by a common timing circuit 42. The light sources 21, 22 and 23 may have a shape other than round, such that they provide the graphical configuration. The windows 13*a* could then be elliptical and tinted, such that the graphical illuminated shape would be provided by the light sources 21, 22 and 23. The light sources 21, 22 and 23, each with lighting elements 20*a*–27*a* would be mounted on lighting panels 44 as seen in FIGS. 2, 2A and 3. The light sources 21, 22 and 23 could be encapsulated for durability of the lighting panels 44 as the previous embodiment.

Besides the graphical shape provided by the windows or the light sources as seen through the windows, the details of the graphic may be placed in one of several alternatives. The details of the flame for example, can be applied on the windows, if the windows are solid material. The graphic details of the flame could be applied to light panels or the light sources if they are large enough, which are seen through the windows. Or, the details of the flame graphic could be placed on a substrate for an individual light source, which is then mounted on a circuit board and encapsulated to form a lighting panel.

Figure 7:
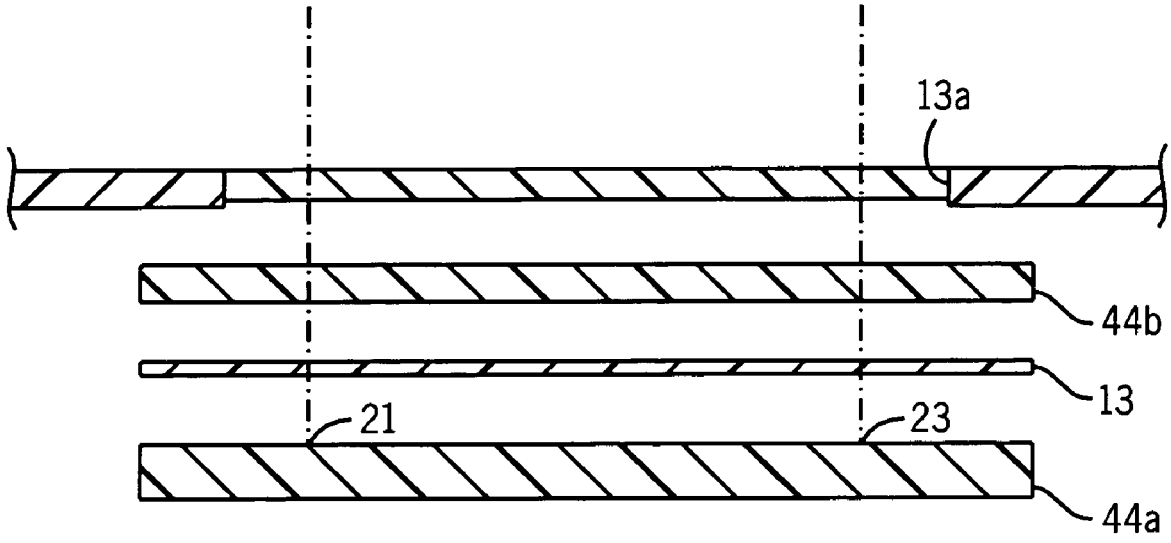
FIG. 7 is a sectional view taken in the plane indicated by line 7—7 in FIG. 1.

These alternative embodiments are represented in FIG. 7, in which the window 13*a* is elliptical and solid. The graphical image 13 of a flame, or other image, can be placed on the substrate 44*a* and illuminated, so that it is seen through the window 13*a*. The image 13 is sealed with the light sources 21, 22 and 23 inside sealing layer 44*b*. It would also be possible to shape sealing layer 44*b* to fit in an open version of window 13*a*, while still providing a sealed assembly and headgear.

Referring again to FIG. 5, when energized, the light sources 20–27 emit radiant light in all possible directions from the substrates 44*a* to which they are soldered or mounted on, allowing maximum viewing angle and light dispersion. Additionally, when these components are energized, each light-emitting element contained within the light source turns on and off to flash, at a rate which can create a strobing effect.

A circuit for supplying power and controlling on-off operation is located on the back lower section of the inner impact-absorbing core ridge 11*b*, and includes a rocker-type switch 28 or any other suitable device for on-off energized operation. The switch 28 is located in and secured inside cavity 30. The cavity 30 contains an impact distribution support 46, which is secured to the back of cavity 30. This support 46 is made of plastic or other suitable material and is the same size as the cavity 30. It is used in the event of a hard impact to the switch 28, to prevent the switch 28 from being forced into the impact-absorbing core material. This switch 28 is connected in series with the power supply assembly 29, containing three (3) AAA batteries 32 connected in series for a total available voltage of 4.5 volts (FIGS. 4 and 6). Switch 28 is connected in parallel with the traces of each circuit board containing their respective light sources 20–27.

Referring to FIGS. 3 and 4, the energy source or power supply 29 is disposed in a cavity 31 located in the back underside area of the inner impact-absorbing core ridge 11*b*. A small 4-sided rectangular container 33 is sized to accept the batteries in the power supply assembly 29. The power supply container 33 is made of plastic material to which two threaded bosses 34 and 35 are positioned on the left and right sides. The top of this container 33 with its threaded bosses 34, 35 is flush with the inside top surface of and is secured inside cavity 31. This power supply container 33 also acts as an impact distribution member.

Power supply assembly 29 is inserted into cavity 31 and secured in place by door 36 which closes the cavity 31 from the bottom. Two screws 37, 38 are inserted through holes in the door 36 to secure the door 36 in the closed position. The door 36 provides access to the power assembly 29, so that exhausted batteries may be replaced with fresh batteries.

Figure 5:
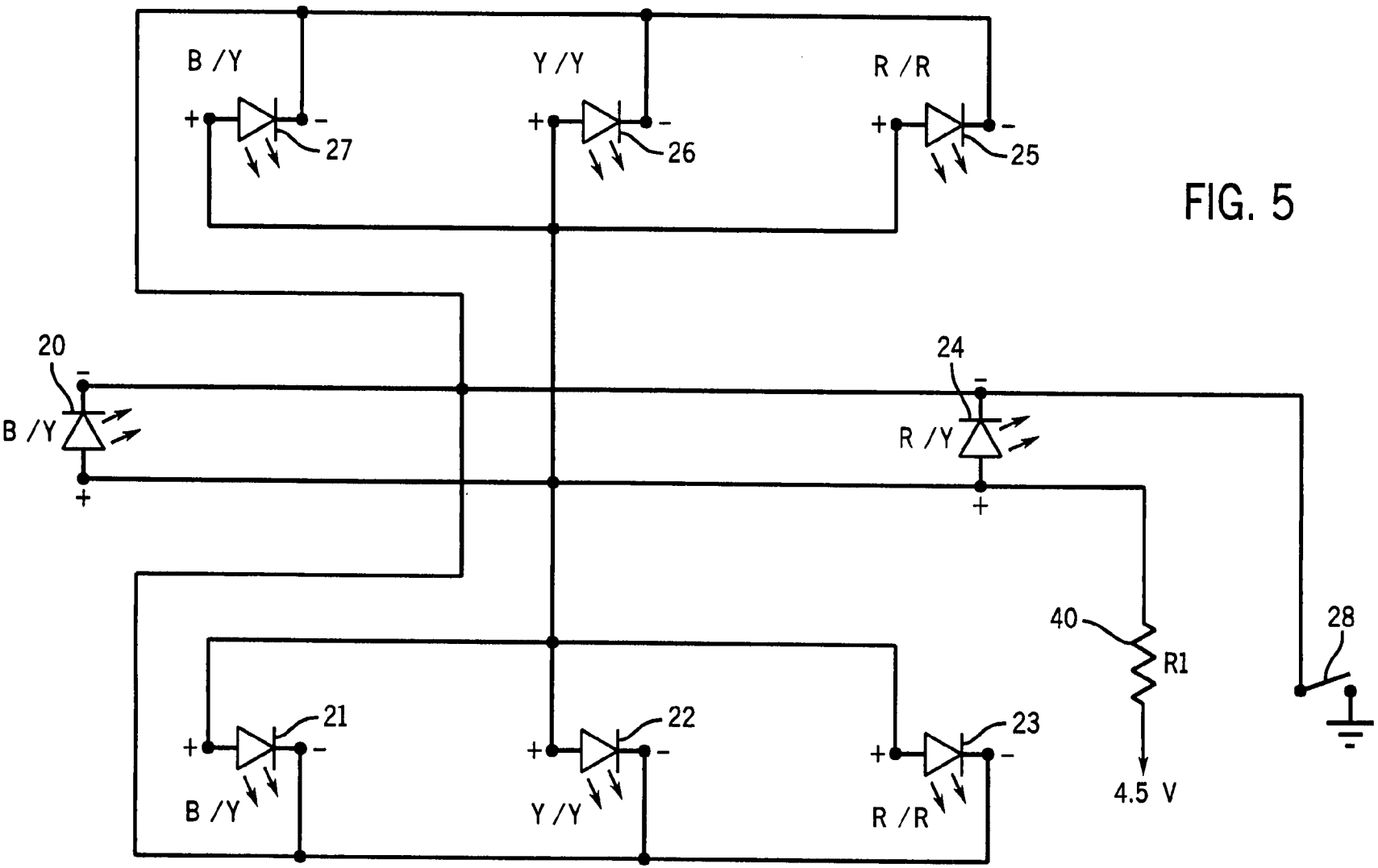
FIG. 5 is a schematic diagram of the electrical circuit included in the headgear of FIGS. 1, 2 and 3.

Referring to FIGS. 4, 5 and 6, switch 28 is located in cavity 30 on the lower back section of the impact-absorbing core ridge 11*b*. It is connected in series with a current limiting resistor 40, 40*a* of suitable resistance, R1, R2 (disposed in pod 43 in FIG. 3), to limit current to the light sources 20–27, 20*a*–27*a* to about 20.0 milliamperes. Upon actuation of switch 28, the light sources 20–27, 20*a*–27*a* are energized on their respective substrates 44*a* to shine through the windows 13 and 14. In FIG. 6, the switch 28*a* can be included with light source 21, 22 or 23 or disposed and the headgear and connected to the light sources 21, 22 and 23.

As represented in FIG. 5, the dual light sources 20–27 include dual light elements with combinations of red/red (R/R), yellow/yellow (Y/Y) and blue/yellow (B/Y) and red/yellow (R/Y). FIG. 6 includes a group of single light elements 20*a*–27*a* and a common timing circuit 42. The light sources 21–23, 21*a*–23*a* and 25–27, 25*a*–27*a* are flashed or strobed through the clear or translucent flame-configured windows 13 of the hard outer shell 12. These light sources 21–23, 21*a*–23*a* and 25–27, 25*a*–27*a* fill their respective cavities 18*a*, 18*b* with light, as a result of their wide angle of light dispersion properties. Reflected light also impinges upon and passes through the windows 13, adding to the amount of light passing through the windows 13. When these light components are energized and their elements flash or strobe, their bright and brilliant colors along with the secondary reflection of light give their particular window shape the perception or illusion of movement as the light now produced seems to wave or blend into the next color, with no defined line of color separation as it passes through the window. In reference to window 13, there is the perception or illusion of movement and realistic varying color changes of an open flame. The same effect occurs on the left side of the illuminated safety helmet in unison with the right.

Referring to FIG. 2, the front of the illuminated safety helmet as being worn by the user. As the composite light emitting diode component 20 having a blue/yellow (B/Y) color combination is energized, it provides a flashing or strobing effect through its window 14. The rear light source 24 utilizes a red/yellow (R/Y) in the same way. While the invention is described in terms of dual light sources, it should be understood that the invention can be practiced with a plurality of individual light sources 20*a*–27*a* operating as a group in combination with timing circuitry 42 as seen in FIG. 6.

As one can easily perceive, there are a multitude of varying color combinations and shapes, sizes, dimensions and locations of graphically shaped light sources and windows that can be used. These can range from animate and inanimate objects to company logos and the like. The term "graphical" should be understood here to exclude mere letters or numbers as shown in the prior art, and generic shapes such as circles, squares and triangles. The desired effects of the invention are achieved when the area of the windows is at least three times the area of one of the light emitting elements in the light sources 20–27, 20*a*–27*a*, and preferably is on the order of four or more times the area of one of the light emitting elements. The invention can utilize various oscillating circuitry such as MOS/CMOS integrated circuits, TTL/LS integrated circuits and linear integrated circuits and their accompanying components to produce an array of timed output voltage signals. In addition to using LEDs of high illumination value, a correct wide degree of viewing angle and color combinations can also be utilized.

The illuminated headgears described herein may be used for, but are not limited to use in, sports and recreational activities.

The intent of the present invention is to reduce the number of components used in the manufacturing process in addition to producing a pleasing, attention-getting and illuminating effect to the eye of the individuals observing the illuminated protective headgear.

It is also an object to instill the visual perception of activity of the user, thereby alerting the observer of the headgear to the user's presence.

The headgear also has a smooth outer surface and aerodynamic shape with the light sources disposed in cavities so as not to project into the outer surface of the headgear. This makes the headgear look like an ordinary type of headgear, when the light sources are not illuminated.

This has been a description of the preferred embodiments and best mode of carrying out the invention, but it will be apparent to those with skill in the art to which the invention pertains that various modifications may be made to these specific embodiments without departing from the spirit of the present invention, and that such modifications are intended to be encompassed by the following claims.

I claim:

1. A headgear comprising:

an inner core of impact-reducing material, said core having cavities therein;

an outer shell overlying said core, said outer shell having a substantially opaque outer surface except for at least two windows that are disposed over said cavities;

a plurality of planar-shaped light sources each supplying a plurality of lighting elements, said planar-shaped light sources being disposed in said cavities, so as to be viewed through the respective windows;

timing circuitry included within at least one of the planar-shaped light sources for timing the on-off operation of the lighting elements, so as to create an effect of motion of the illumination within each light source; and at least one image that is disposed in alignment with each of said windows, said image being disposed on at least one of:

said windows, said light sources, and substrates supporting said light sources; and wherein said image is illuminated by said light sources so as to be viewed externally to said headgear.

2. The headgear of claim 1, wherein the windows each have the shape of a flame.

3. The headgear of claim 2, wherein the light sources provide lights of different colors.

4. The headgear of claim 3, wherein each planar-shaped light source has a much greater width dimension at a base than a height dimension to provide a wide angle of view, with a plurality of lights, and wherein the timing circuitry includes means for flashing the lights in a timed mode of operation.

5. The headgear of claim 4, wherein the timed operation produces a strobing of the lighting elements.

6. The headgear of claim 3, wherein the light sources are encapsulated in at least one lighting panel by a light-transmissive encapsulating material.

7. The headgear of claim 6, wherein each planar-shaped light source has a much greater width dimension at a base than a height dimension to provide a wide angle of view, with a plurality of lights, and wherein the timing circuitry includes means for flashing the lights in a timed mode of operation.

8. The headgear of claim 2, wherein the light source provide lights of a same color.

9. The headgear of claim 7, wherein the timed operation produces a strobing of the lighting elements.

10. The headgear of claim 8, wherein the light sources are encapsulated in at least one lighting panel by a light-transmissive encapsulating material.

11. The headgear of claim 2, wherein each planar-shaped light source has a much greater width dimension at a base than a height dimension to provide a wide angle of view, with a plurality of lights, and wherein the timing circuitry includes means for flashing the lights in a timed mode of operation.

12. The headgear of claim 11, wherein the timed operation produces a strobing of the lighting elements.

13. The headgear of claim 11, wherein the light sources are encapsulated in at least one lighting panel by a light-transmissive encapsulating material.

14. The headgear of claim 13, wherein the circuit supporting substrates supporting said light sources are curved along a profile corresponding to the shape of an outer surface of the core.

15. The headgear of claim 1, wherein the windows have an area at least three times the area of any light-emitting element contained within the light source.

16. The headgear of claim 15, wherein the light sources provide lights of different colors.

17. The headgear of claim 6, wherein each planar-shaped light source has a much greater width dimension at a base than a height dimension to provide a wide angle of view, with a plurality of lights, and wherein the timing circuitry includes means for flashing the lights in a timed mode of operation.

18. The headgear of claim 17, wherein the timed operation produces a strobing of the lighting elements.

19. The headgear of claim 15, wherein the light source provide lights of a same color.

20. The headgear of claim 19, wherein each planar-shaped light source has a much greater width dimension at a base than a height dimension to provide a wide angle of view, with a plurality of lights, and wherein the timing circuitry includes means for flashing the lights in a timed mode of operation.

21. The headgear of claim 20, wherein the timed operation produces a strobing of the lighting elements.

22. The headgear of claim 20, wherein the light sources are encapsulated in at least one lighting panel by a light-transmissive encapsulating material.

23. The headgear of claim 15, wherein each planar-shaped light source has a much greater width dimension at a base than a height dimension to provide a wide angle of view, with a plurality of lights, and wherein the timing circuitry includes means for flashing the lights in a timed mode of operation.

24. The headgear of claim 23, wherein the timed operation produces a strobing of the lighting elements.

25. The headgear of claim 15, wherein the light sources are encapsulated in at least one lighting panel by a light-transmissive encapsulating material.

26. The headgear of claim 25, wherein the circuit supporting substrates supporting said light sources are flexible.

27. The headgear of claim 1, wherein each planar-shaped light source has a much greater width dimension at a base than a height dimension to provide a wide angle of view, with a plurality of lights, and wherein the timing circuitry includes means for flashing the lights in a timed mode of operation.

28. The headgear of claim 27, wherein the timed mode of operation produces a strobing of the lighting elements.

29. The headgear of claim 1, wherein the light sources are encapsulated in at least one lighting panel by a light-transmissive encapsulating material.

30. The headgear of claim 29, wherein the substrates supporting said light sources are that are curved along a profile corresponding to the shape of an outer surface of the core.

31. The headgear of claim 1, further including at least two circuit supporting substrates disposed in respective cavities beneath said windows for supporting the light sources.

32. The headgear of claim 1, further comprising a battery source of power for supplying power to the light sources.

33. The headgear of claim 1, further comprising two windows which are at least translucent and are located at a front and back of the headgear, respectively, and light sources being positioned inside of said respective windows at the front and back for being seen through said windows.

34. The headgear of claim 33, wherein the outer shell is releasably secured to the inner core.

35. The headgear of claim 1, wherein the outer shell of plastic is made of a translucent, white or clear material and is coated with a coating of opaque color that forms the translucent windows having graphical configurations.

36. The headgear of claim 1, wherein the headgear has a smooth outer surface and aerodynamic shape with the light sources disposed in said cavities so as not to project into the outer surface of the headgear.

37. The headgear of claim 1, wherein the image is a graphical image.

38. The headgear of claim 37, wherein the graphical image has a shape of a flame.

* * * * *